US008142140B2

(12) United States Patent
Warizaya

(10) Patent No.: US 8,142,140 B2
(45) Date of Patent: Mar. 27, 2012

(54) FAN UNIT, ELECTRONIC APPARATUS WITH FAN UNIT, METHOD OF OPENING/CLOSING SHUTTER OF FAN UNIT, AND SHUTTER

(75) Inventor: Kanji Warizaya, Tokyo (JP)

(73) Assignee: NEC Corporation, Tokyo (JP)

( * ) Notice: Subject to any disclaimer, the term of this patent is extended or adjusted under 35 U.S.C. 154(b) by 1041 days.

(21) Appl. No.: 12/052,942

(22) Filed: Mar. 21, 2008

(65) Prior Publication Data

US 2008/0232955 A1 Sep. 25, 2008

(30) Foreign Application Priority Data

Mar. 23, 2007 (JP) ..... 2007-076395

(51) Int. Cl.
*F03D 7/04* (2006.01)
*F04D 25/10* (2006.01)

(52) U.S. Cl. ..... 415/146; 415/148; 415/182.1; 454/184

(58) Field of Classification Search ..... 137/108.01; 361/679.46, 679.48, 688, 690, 694; 415/26, 415/36, 46, 48, 49, 50, 146, 148, 149.1, 182.1; 454/184, 259, 347
See application file for complete search history.

(56) References Cited

U.S. PATENT DOCUMENTS 6,688,965 B1 * 2/2004 Crippen et al. ..... 454/184
7,070,385 B2 * 7/2006 Milana ..... 415/25

FOREIGN PATENT DOCUMENTS

| | | |
|---|---|---|
| JP | 2-52495 | 4/1990 |
| JP | 3-18532 | 2/1991 |
| JP | 6-20845 | 3/1994 |
| JP | 06-111559 | 4/1994 |
| JP | 10-065373 | 3/1998 |
| JP | H11-022698 | 1/1999 |
| JP | U3064753 | 9/1999 |
| JP | 2002-176281 | 6/2002 |
| JP | 2005-011304 | 1/2005 |
| JP | 2006-059448 | 3/2006 |

* cited by examiner

*Primary Examiner* — Edward Look
*Assistant Examiner* — Jason Davis
(74) *Attorney, Agent, or Firm* — Scully, Scott, Murphy & Presser, P.C.

(57) ABSTRACT

There is provided a fan unit including a shutter capable of closing the shutter despite a change in installation direction of the fan unit, an electronic apparatus including such fan unit, a method of opening/closing the fan unit, and the shutter. In the fan unit with the shutter, the shutter is opened and closed in different directions according to the installation direction of the fan unit.

14 Claims, 7 Drawing Sheets

FIG. 2A
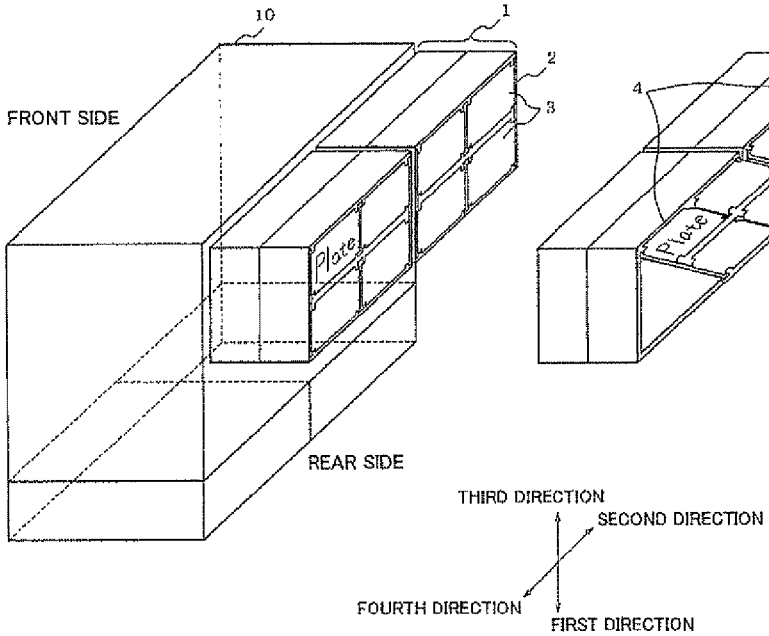
FIG. 2B
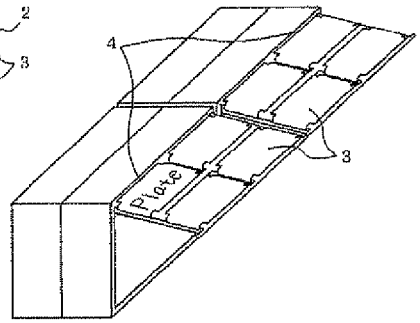
FIG. 3A
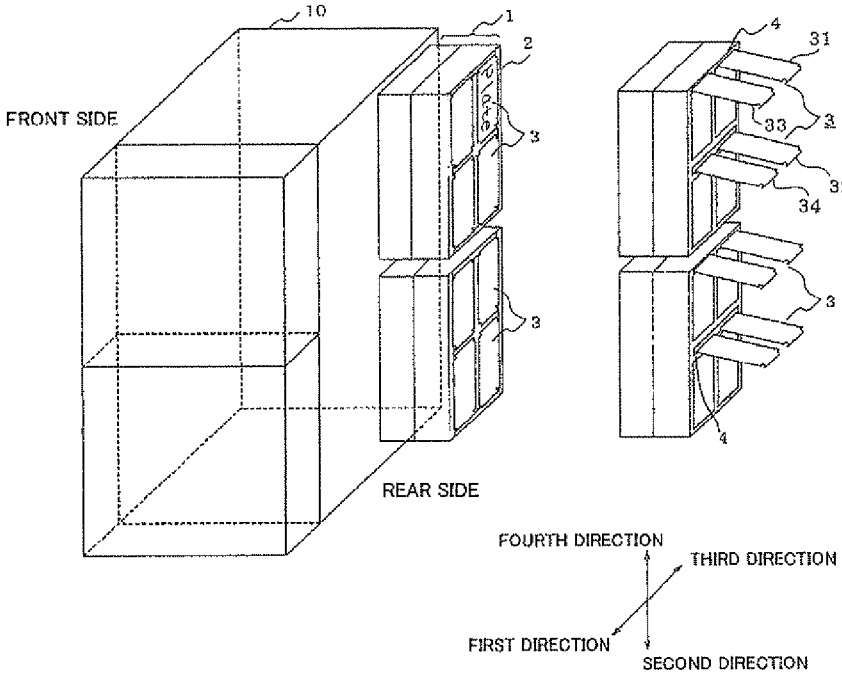
FIG. 3B

THIRD DIRECTION ⟷ FIRST DIRECTION

FAN UNIT, ELECTRONIC APPARATUS WITH FAN UNIT, METHOD OF OPENING/CLOSING SHUTTER OF FAN UNIT, AND SHUTTER

This application is based on Japanese patent application No. 2007-076395, the content of which is incorporated hereinto by reference.

BACKGROUND

1. Technical Field

The present invention relates to a fan unit, an electronic apparatus including the fan unit, a method of opening/closing a shutter of the fan unit, and to the shutter, and more particularly to a fan unit including a shutter that can change an opening/closing direction according to an installation direction, an electronic apparatus including such fan unit, a method of opening/closing the shutter of the fan unit, and the shutter.

2. Related Art

Fan units have been used in various situations. For example, in electronic apparatuses such as a server or a disk array unit, the fan unit is employed for efficiently dissipating the heat generated in the apparatus. In various cases, the fan unit includes a shutter that blocks a reverse flow of air against the fan unit in case of a malfunction that causes the fan unit to stop. The electronic apparatus including a fan unit with a shutter can be found, for example, in JP-A No. H11-022698, JP-A No. 2005-011304, and JP-A No. 2006-059448.

[Patented document 1] JP-A No. H11-022698

[Patented document 2] JP-A No. 2005-011304

[Patented document 3] JP-A No. 2006-059448

The shutter of a conventional fan unit is set to close with its own weight because of the gravity, as described in the patented documents 1 and 2. Naturally, when the installation direction of the apparatus is changed (for example, vertical to horizontal), the shutter becomes unable to be closed. This permits air to reversely flow, thereby decreasing the amount of air introduced into the apparatus through the front side, which may lead to degraded cooling efficiency for the apparatus.

The patented document 3 discloses a fan unit including a mechanism that applies a force to the shutter from a hinge portion or the like, so as to cause the shutter to close the ventilation port. Such fan unit is, however, not yet free from the drawback that the shutter cannot be closed in the case where the apparatus is installed in a different direction. For example, when the gravity acts in a direction to open the shutter, the force urging the shutter to close may be overcome by the self weight of the shutter, thus leaving the shutter open. In this case, the force acting on the shutter from the hinge portion may be increased, so as to inhibit the shutter from remaining open even though the gravity acts in a direction to open the shutter. Increasing such force, however, in turn incurs the need to increase the force to open the shutter. For example, in the case where the mechanism utilizes the wind pressure of the fan to open the shutter, the shutter cannot be opened if the wind pressure is insufficient.

Accordingly, an object of the present invention is to provide a fan unit including a shutter capable of closing the shutter despite a change in installation direction of the fan unit, an electronic apparatus including such fan unit, and a method of opening/closing the fan unit.

SUMMARY

In one embodiment, there is provided a fan unit comprising a shutter that closes in different directions with respect to the fan unit, according to an installation direction of the fan unit.

In another embodiment, there is provided an electronic apparatus comprising a fan unit including a shutter that closes in different directions with respect to the fan unit, according to an installation direction of the fan unit.

In still another embodiment, there is provided a method of opening and closing a shutter of a fan unit, comprising opening and closing the shutter in different directions with respect to the fan unit, according to an installation direction of the fan unit.

In still another embodiment, there is provided a shutter that opens upon being rotated about a pivot shaft by a wind pressure of a fan, wherein a self weight of the shutter applies a closing force to the shutter once the shutter is opened, in each of the cases where the shutter is installed in a plurality of directions.

The present invention provides the advantage that, in a fan unit including a shutter, and an electronic apparatus including the fan unit, the shutter can be closed despite a change in installation direction of the fan unit. This is achieved by providing a fan unit including a shutter that opens and closes in different directions with respect to the fan unit, according to an installation direction of the fan unit.

BRIEF DESCRIPTION OF THE DRAWINGS

The above and other objects, advantages and features of the present invention will be more apparent from the following description of certain preferred embodiments taken in conjunction with the accompanying drawings, in which:

FIGS. 2A and 2B are perspective views showing an electronic apparatus including the fan unit 1, being horizontally installed;

FIGS. 3A and 3B are perspective views showing the electronic apparatus including the fan unit 1, being vertically installed;

DETAILED DESCRIPTION

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Through the following passages, firstly a general concept of the present invention will be described referring to FIG. 1. Then an overall configuration according to an embodiment of the present invention will be described, referring to FIGS. 2A to 3B. Referring then to FIGS. 4 through 8D, description will be given on detailed structure of a fan unit 1 according to the embodiment.

Figure 1A:
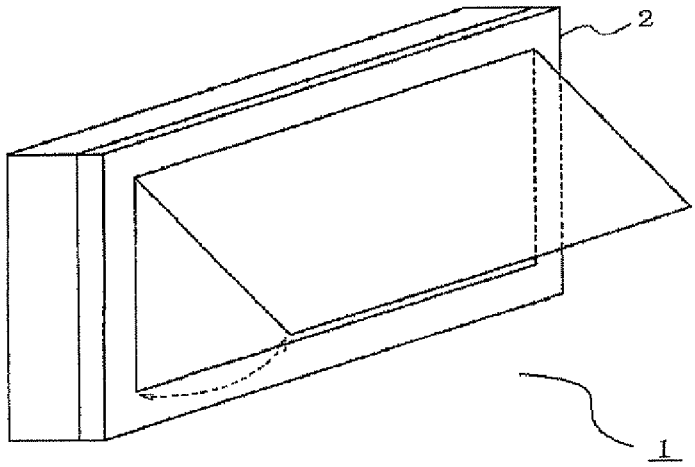
FIGS. 1A and 1B are perspective views schematically showing a fan unit 1 according to an embodiment of the present invention.
Figure 1B:
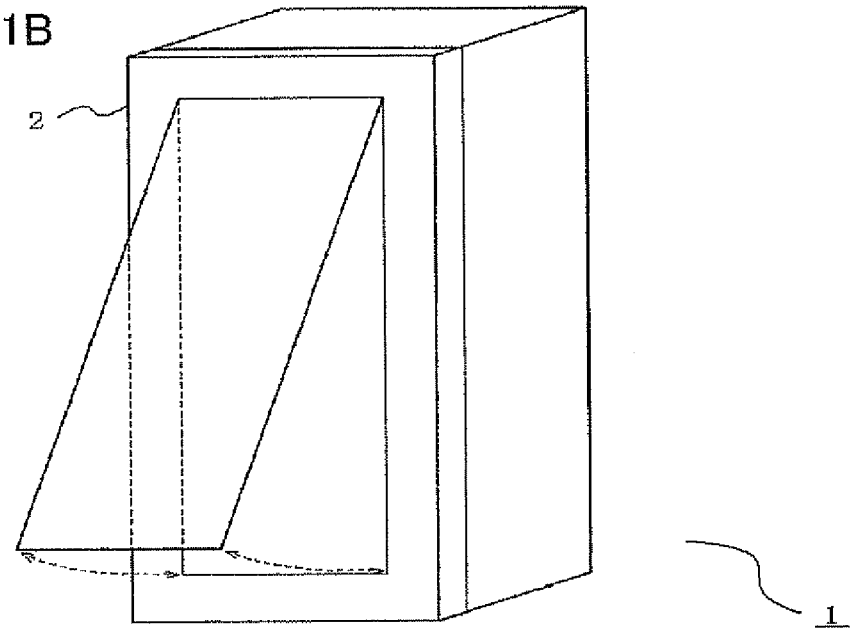

To start with, the outline of the present invention will be described. FIGS. 1A and 1B are perspective views schematically showing the fan unit 1. FIG. 1A is a perspective view of the fan unit 1, installed in a certain direction.

The installation direction of the fan unit 1 herein refers to one of the directions that the fan unit is installed, when the fan unit 1 is rotated around the blowing direction of the fan as the axis. For example, the installation direction of the fan unit 1 changes depending on whether the fan unit 1 is installed vertically or horizontally.

A shutter 2 of the fan unit 1 opens and closes about a shaft located on an upper side of the drawing sheet. The fan unit 1 includes therein a fan (not shown), and the shutter 2 is opened by the wind pressure of the fan while the fan is working. When the fan is not working, the shutter 2 is closed because of its self weight, thereby blocking the air outlet of the fan.

FIG. 1B is a perspective view of the fan unit 1, installed in a different direction. FIG. 1B shows an example where the fan unit 1 is installed in a direction rotated by 90 degrees around the blowing direction of the fan, with respect to the state shown in FIG. 1A. In this case also, the shutter 2 opens and closes about a shaft located on an upper side of the drawing sheet. Accordingly, upon comparing FIG. 1A and FIG. 1B, it is understood that the shutter 2 opens and closes in different directions with respect to the fan unit 1. Thus, in FIG. 1B also, while the fan is working the shutter 2 is rotated about a pivot shaft (plate shaft 4 shown in FIG. 2B) and kept open by the wind pressure of the fan. When the fan is not working, the shutter 2 can close with its self weight. Consequently, despite the change in installation direction of the fan unit 1, the shutter 2 in the open state is subjected to a closing force around the pivot shaft because of its self weight, and can thereby be closed.

Referring to FIGS. 2A to 3B, the overall configuration according to the embodiment will be described hereunder.

FIGS. 2A and 2B are perspective views showing an electronic apparatus including the fan unit 1 according to the embodiment, being horizontally installed. In this embodiment, a disk array unit 10 is employed as an example of the electronic apparatus. In FIG. 2A, the left-hand side of the disk array unit 10 is the front side thereof including an operating panel and so on, and the right-hand side is the rear side of the disk array unit 10. The fan unit 1 is mounted on the rear side of the disk array unit 10. In the fan unit 1, air is inspired through the front side of the disk array unit 10, and discharged through the opposite side, i.e. the rear side.

For the purpose of the subsequent description, the installation direction of the disk array unit 10, hence the fan unit 1, will be defined. Firstly, reference directions will be defined. A downward direction in FIG. 2A will be referred to as a first direction; a direction going away from the viewer to the right in FIG. 2A as a second direction; an upward direction in FIG. 2A as a third direction, and a direction coming up to the viewer to the left in FIG. 2A as a fourth direction. Now regarding the installation direction, a direction along which the gravity acts on the disk array unit 10 (or the fan unit 1) will be referred to as the installation direction of the disk array unit 10 (or the fan unit 1). In the example of FIGS. 2A and 2B, the disk array unit 10, and hence the fan unit 1, are installed in the first installation direction.

Back to the subject of the fan unit 1, FIG. 2A is a perspective view showing the state that the fan unit 1 is not working. The fan unit 1 includes the shutter 2, and the shutter 2 includes a shutter plate 3 to be opened by the wind pressure of the fan. In FIG. 2A, since the fan in the fan unit 1 is not working, the shutter 2 is closed.

FIG. 2B is a perspective view showing the state that the fan unit 1 of FIG. 2A is working. The shutter plate 3 is rotated by the wind pressure about the plate shaft 4 (plate shaft 41 to be described later) located at an upper portion of the shutter plate 3, so that an entirety of the shutter 2 is opened.

FIGS. 3A and 3B are perspective views showing the electronic apparatus including the fan unit 1, being vertically installed. FIG. 3A is a perspective view showing the state that the fan unit 1 is not working. In FIG. 3A, the disk array unit 10 (or the fan unit 1) is installed in the second direction. In FIG. 3A the fan unit 1 is not working, and hence the shutter 2 is closed.

FIG. 3B is a perspective view showing the state that the fan unit 1 of FIG. 3A is working. In the example shown in FIGS. 3A and 3B, the shutter plate 3 of each fan unit 1 includes four shutter plates 31, 32, 33, 34. The shutter plates 31 to 34 are individually rotated by the wind pressure about the plate shaft 4 (plate shaft 42, 45 to be described later) located at an upper portion of the shutter plates 3, thus to be opened. Accordingly, the shutter 2 is partially opened. Here, the direction of the pivot shaft (plate shaft 42, 45 to be described later) of the shutter plate 3 shown in FIG. 3B and that of the pivot shaft (plate shaft 41 to be described later) of the shutter plate 3 shown in FIG. 2B are orthogonal to each other.

Referring now to FIGS. 4 through 8D, description will be given on detailed structure of the fan unit 1 according to the embodiment. Firstly the structural relationship between the shutter plate 3 and the plate shaft 4 will be described in details, referring to FIG. 4 to 5C. Then the mechanism involving the plate shaft 4, a base 7, and a slide plate 6 will be described in details referring to FIGS. 4 and 6 to 8D.

Figure 4:
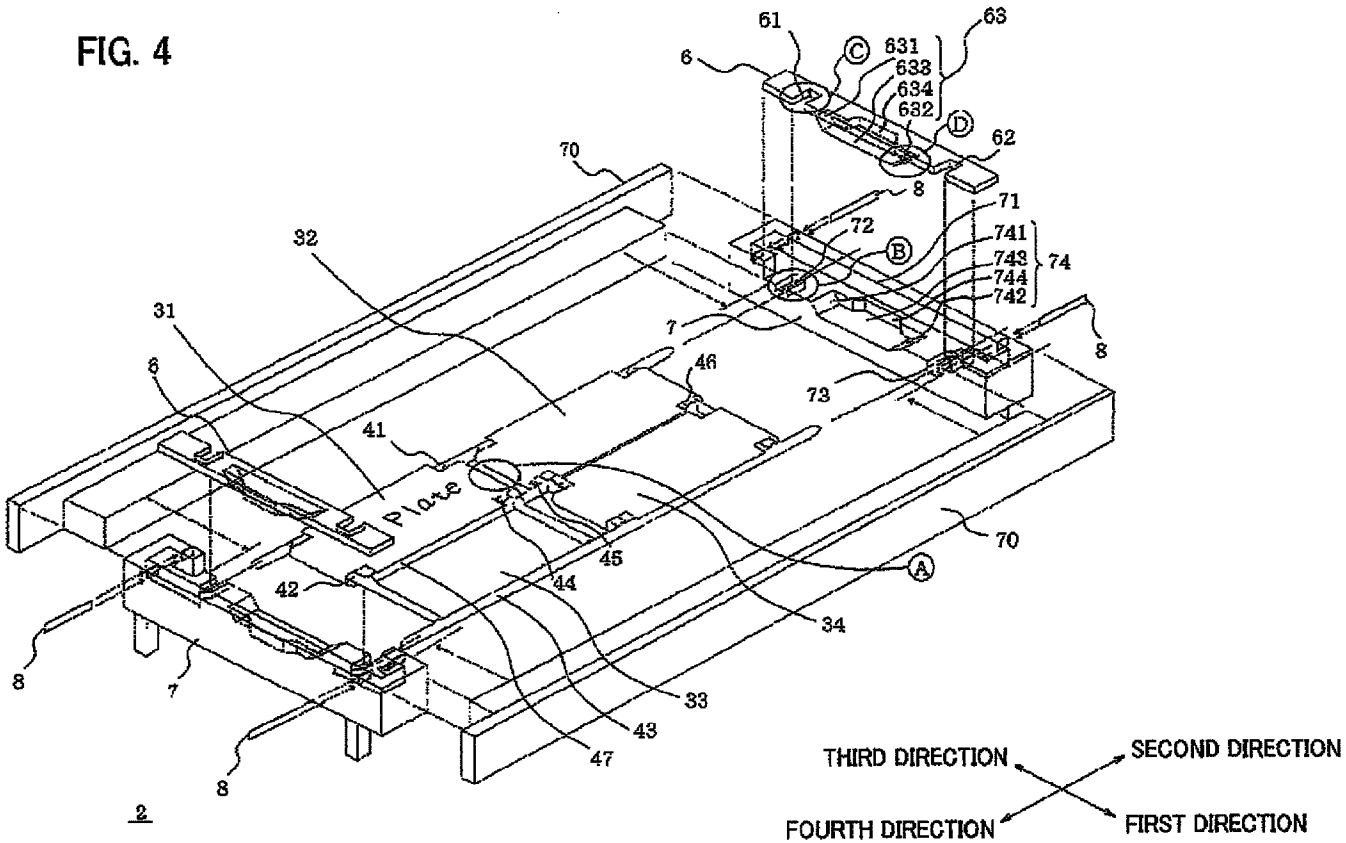
FIG. 4 is a perspective view showing a shutter 2 of the fan unit 1.

FIG. 4 is a perspective view showing a structure of the shutter 2 of the fan unit 1. The air outlet of the fan unit 1 is facing upward in FIG. 4. Accordingly, air is introduced into the fan unit 1 from a lower side of FIG. 4. A direction coming up to the viewer to the right from FIG. 4 is the first direction; a direction going away from the viewer to the right in FIG. 4 the second direction; a direction going away from the viewer to the left in FIG. 4 the third direction; and a direction coming up to the viewer to the right from FIG. 4 the fourth direction.

The shutter 2 of the fan unit 1 includes the shutter plate 3, the plate shaft 4, the slide plate 6, the base 7, a base frame 70, and a wedge 8. The plate shaft 4 includes a plate shaft 41, a plate shaft 42, a plate shaft 43, a plate shaft 44, a plate shaft 45, a plate shaft 46, and a plate shaft 47. The shutter plate 3 includes the shutter plate 31, the shutter plate 32, the shutter plate 33, and the shutter plate 34.

The base 7 and the base frame 70, constituting the outer frame of the shutter 2, will be first described. Secondly, the shutter plate 3 and the plate shaft 4 provided inside the outer frame will be described. Thereafter, the engagement between the outer frame and the internal components will be described.

The base frame 70 includes a pair of base frame members extending in the second and the fourth direction, so as to fasten the base 7.

The base 7 includes a pair of base members extending in the first and the third direction, so as to serve as a bearing for the plate shaft 4. The respective end portions of the pair of base frame members are connected to the respective end portions of the pair of base members. Thus, the pair of the bases frame 70 and the pair of the base 7 constitute the outer frame of the fan unit 1.

The fan unit 1 includes, inside such outer frame, the shutter plate 3 and the plate shaft 4. Hereinafter, the region in the fan unit 1 where the shutter plate 3 and the plate shaft 4 are located will be referred to as "inside the fan unit 1". The structure of the shutter plate 3 and the plate shaft 4 will be described in details, referring also to FIGS. 5A to 5C, in addition to FIG. 4.

Figure 5A:
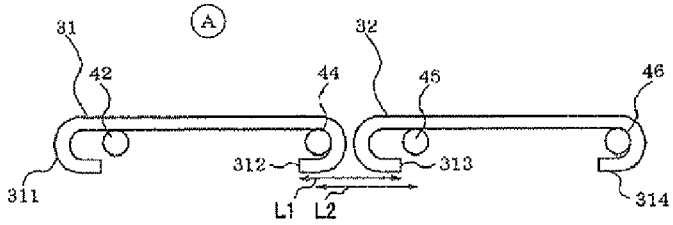
FIGS. 5A and 5B are cross-sectional views and FIG. 5C is a plan view, enlarged from a portion designated by (A) in FIG. 4.
Figure 5B:
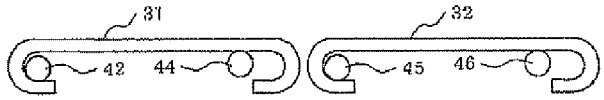
Figure 5C:
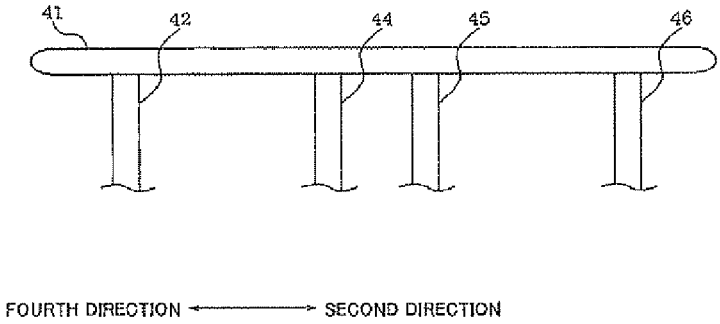

FIGS. 5A to 5C are enlarged drawings of a portion designated by (A) in FIG. 4. FIG. 5A is a cross-sectional view of the plate shaft 4 and the shutter plate 3 viewed from the first direction, with the fan unit 1 placed in the fourth installation direction in FIG. 4. FIG. 5B is a cross-sectional view of the plate shaft 4 and the shutter plate 3 viewed from the first direction, with the fan unit 1 placed in the second installation direction in FIG. 4. FIG. 5C depicts the plate shaft 4 viewed from above in FIG. 4 (air outlet side of fan unit 1). For the sake of explicitness, the shutter plate 3 is excluded from FIG. 5C. In FIGS. 5A and 5B, the air outlet of the fan unit 1 is upwardly directed.

Referring to FIGS. 4 and 5C, the plate shaft 41, the plate shaft 43, and the plate shaft 47 extend in the second and the fourth direction, in parallel to one another. The plate shaft 42, the plate shaft 44, the plate shaft 45, and the plate shaft 46 extend in the first and the third direction, in parallel to one another. The plate shaft 42, the plate shaft 44, the plate shaft 45, and the plate shaft 46 are each connected at the respective end portions to the plate shaft 41 and the plate shaft 43, and at the respective middle portion to the plate shaft 47. The plate shaft 42, plate shaft 44, plate shaft 45, and the plate shaft 46 are aligned in the order of the numerals.

Referring to FIGS. 4, 5A and 5B, the four shutter plates 31, 32, 33, 34 are pivotally engaged with the plate shaft 4. Hereunder, the relationship between the shutter plate 31 and the shutter plate 32 will be described, referring to the four shutter plates 31 to 34 as a representative example.

The shutter plate 31 is located between the plate shaft 41 and the plate shaft 47, and between the plate shaft 42 and the plate shaft 44. In other words, the plate shaft 41, the plate shaft 47, the plate shaft 42, and the plate shaft 44 are engaged with the edge portions of the shutter plate 31. The shutter plate 31 includes a central flat portion, and bearing portions provided on the respective edge portions of the flat portion, so as to be engaged with the plate shaft 42 and the plate shaft 44. In this embodiment, the bearing portion includes a first engaging portion 311 and a second engaging portion 312, respectively having a J-shaped cross-section. The inner surface of the J-shaped curved portion of the first engaging portion 311 and the inner surface of the J-shaped curved portion of the second engaging portion 312 are opposing each other. The curved portion having the J-shaped cross-section of the first engaging portion 311 is pivotally engaged with the plate shaft 42. The curved portion having the J-shaped cross-section of the second engaging portion 312 is pivotally engaged with the plate shaft 44.

The shutter plate 32 is located between the plate shaft 41 and the plate shaft 47, and between the plate shaft 45 and the plate shaft 46. The shutter plate 32 includes a central flat portion, and a third engaging portion 313 and a fourth engaging portion 314, respectively having a J-shaped cross-section, which serve as bearing portions provided on the respective edge portions of the flat portion, so as to be engaged with the plate shaft 45 and the plate shaft 46. The curved portion having the J-shaped cross-section of the third engaging portion 313 is pivotally engaged with the plate shaft 45. The curved portion having the J-shaped cross-section of the fourth engaging portion 314 is pivotally engaged with the plate shaft 46. The plate shaft 44 and the plate shaft 45 are adjacent to each other, and hence the second engaging portion 312 and the third engaging portion 313 are also adjacent to each other.

In the case where the fan unit 1 is set in the fourth installation direction, the shutter plate 31 and the shutter plate 32 are displaced in the fourth direction (toward the left in FIG. 5A), owing to the self weight. In other words, when the fan unit 1 is placed such that the plate shaft 44 is located above the plate shaft 42, the shutter plate 31 moves away from the plate shaft 44, toward the plate shaft 42. When the fan unit 1 is set such that the plate shaft 46 is located above the plate shaft 45, the shutter plate 32 moves away from the plate shaft 46, toward the plate shaft 45. As a result, the second engaging portion 312 gets pivotally engaged with the plate shaft 44. The fourth engaging portion 314 gets pivotally engaged with the plate shaft 46. On the other hand, the first engaging portion gets disengaged from the plate shaft 42. The third engaging portion also gets disengaged from the plate shaft 45.

Upon activating the fan unit 1 under such state, wind is generated upward in FIG. 5A, so that the wind pressure causes the shutter plate 31 to rotate about the plate shaft 44. The shutter plate 32 is also rotated about the plate shaft 46, and thus the shutter plate 31 and the shutter plate 32 are opened. When the fan unit 1 stops working, the shutter plate 31 and the shutter plate 32 close because of their self weight.

In the case where the fan unit 1 is set in the second installation direction, the shutter plate 31 and the shutter plate 32 are displaced in the second direction (toward the right in FIG. 5B), owing to the self weight. As a result, the first engaging portion 311 gets pivotally engaged with the plate shaft 42. The third engaging portion 313 gets pivotally engaged with the plate shaft 45. On the other hand, the second engaging portion 312 gets disengaged from the plate shaft 44. The fourth engaging portion 314 also gets disengaged from the plate shaft 46.

Upon activating the fan unit 1 under such state, wind is generated upward in FIG. 5B, so that the wind pressure causes the shutter plate 31 to rotate about the plate shaft 42. The shutter plate 32 is also rotated about the plate shaft 45, and thus the shutter plate 31 and the shutter plate 32 are opened. When the fan unit 1 stops working, the shutter plate 31 and the shutter plate 32 close because of their self weight.

Here, it is assumed that the second engaging portion 312 and the third engaging portion 313 have come as close as possible to each other. Even in this case, the distance (L1) between the edge of the second engaging portion 312 (tip point of the letter J of the J-shaped cross-section) and the edge of the third engaging portion 313 (tip point of the letter J of the J-shaped cross-section) is longer than the distance (L2) between the centers of the plate shaft 44 and the plate shaft 45. Accordingly, there is no chance that the second engaging portion 312 and the third engaging portion 313 are disengaged from the plate shaft 44 or the plate shaft 45, except for the case where the shutter plate 31 and the shutter plate 32 have been displaced in the fourth direction or in the second direction. In other words, in the case where the disk array unit 10 (or the fan unit 1) is horizontally installed (either first installation direction or third installation direction), the second engaging portion 312 and the third engaging portion 313 of the shutter plates 31, 32 do not get disengaged.

In the case where the fan unit 1 is horizontally installed, the engaging portion (for example, first engaging portion 311 or second engaging portion 312) and the plate shaft (for example, plate shaft 42 or plate shaft 44) are not disengaged, even though the shutter plate (for example, shutter plate 31) is biased in the second or the fourth direction. This is because, once the wind pressure of the fan causes the entirety of the shutter 2 to open about the plate shaft 41 serving as the pivot shaft, the shutter plate is biased toward the plate shaft by the self weight, while closing because of the self weight.

Now the structure associated with the plate shaft 4, the base 7, and the slide plate 6 will be described in details, referring to FIGS. 4, and 6 to 8D. Referring first to FIGS. 4 and 6, the mechanism related to the plate shaft 4 and the base 7 will be described. Then the mechanism related to the plate shaft 4, the base 7, and the slide plate 6 will be described, referring to FIGS. 4, 7A and 7B. Referring finally to FIGS. 4 and 8A to 8D, the mechanism related to the base 7 and the slide plate 6 will be described.

Referring first to FIGS. 4 and 6, the structure of the plate shaft 4 and the base 7 will be described.

FIG. 4 shows seven plate shafts 41 to 47. Also, out of the two bases shown in FIG. 4, only one will be described since the shape is the same except for the orientation.

As shown in FIG. 4, the plate shaft 42 and the plate shaft 46 are connected, at the respective end portions, to the plate shaft 41 and the plate shaft 43. The plate shaft 41 and the plate shaft 43 extend farther beyond the connection point with the plate shaft 42 and the plate shaft 46. These extensions are pivotally supported by a groove 72 and a groove 73 formed on the base 7, as will be subsequently described.

The base 7 includes a slide plate fitting slot 71, the groove 72, the groove 73, a base recessed portion 74, on the air outlet side of the fan unit 1 (upper side in FIG. 4). The slide plate fitting slot 71 is a recessed portion for the slide plate 6 to be fitted in the base 7. The groove 72 and the groove 73 are provided on the bottom surface of the slide plate fitting slot 71, for pivotally supporting the plate shaft 41 and the plate shaft 43. The groove 72 and the groove 73 are provided from the edge of the base 7 facing the inside of the fan unit 1 toward an inner portion of the base 7. The interval between the groove 72 and the groove 73 is the same as the interval between the plate shaft 41 and the plate shaft 43. The base recessed portion 74 will be described later.

Figure 6A:
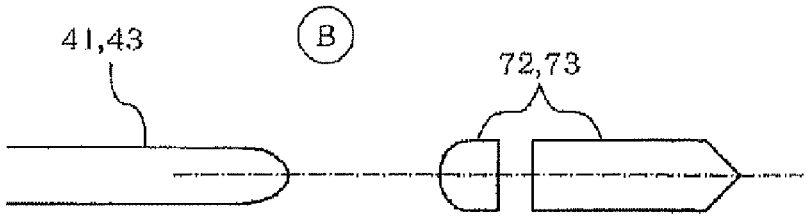
FIG. 6A is a schematic drawing enlarged from a portion designated by (B) in FIG. 4
Figure 6B:
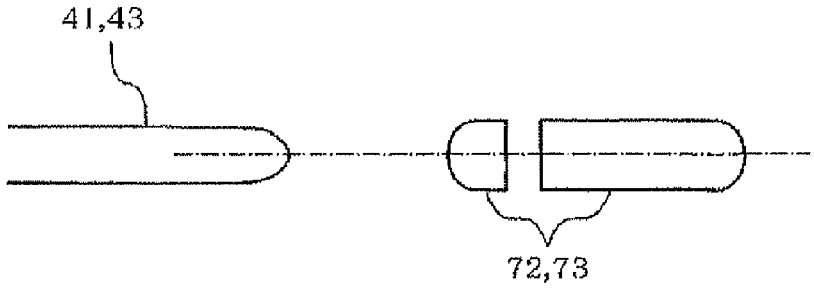
FIG. 6B is a variation thereof.

Referring to FIGS. 6A and 6B, the shape of the groove 72 and the groove 73, as well as the engagement between the grooves 72, 73 and the plate shafts 41, 43 will be described. FIG. 6A is an enlarged drawing of a portion designated by (B) in FIG. 4.

The left portion of FIG. 6A shows the plate shaft 41 and the plate shaft 43. The plate shaft 41 and the plate shaft 43 are shaft having a circular cross-section. The tip portion is of a semi-spherical shape.

The central portion of FIG. 6A is a cross-sectional view of the groove 72 and the groove 73 viewed from the inside of the fan unit 1 (from lower left portion in FIG. 4). The right portion of FIG. 6A show the groove 72 and the groove 73 viewed from the discharging direction of the fan unit 1 (from upper portion in FIG. 4). The groove 72 and the groove 73 have a U-shaped cross-section, as shown in the central portion of FIG. 6A. The groove 72 and the groove 73 have a pointed dead end, from which inclined straight walls are provided toward the respective side edges of the groove, as shown in the right portion of FIG. 6A.

The curved surface of the plate shaft 41 and the plate shaft 43 contacts the curved surface of the groove 72 and the groove 73. Also, the semi-spherical tip portion of the plate shaft 41 and the plate shaft 43 is butted to the end portion of the groove 72 and the groove 73, at two points. With such shapes, the groove 72 and the groove 73 serve to locate the plate shaft 41 and the plate shaft 43 at the widthwise center of the groove 72 and the groove 73 respectively. Such configuration offers the advantage that, since the end portion of the groove 72 and the groove 73 is angular, the grooves can be easily formed by cutting.

The central portion and right portion of FIG. 6B depict a variation of the shape of the groove 72 and the groove 73. In this variation, the groove 72 and the groove 73 have a semi-spherical terminal portion. Accordingly, the semi-spherical tip portion of the plate shaft 41 and the plate shaft 43 and the terminal portion of the groove 72 and the groove 73 make contact at a single point. Because of the contact at a single point instead of two points, the variation offers the advantage of smaller friction between the plate shaft 41 and the groove 72, and between the plate shaft 43 and the groove 73, when the plate shaft 41 and the plate shaft 43 rotate.

The mechanism related to the plate shaft 4, the base 7, and the slide plate 6 will now be described, referring to FIGS. 4, 7A and 7B.

As shown in FIG. 4, the slide plate 6 is a flat plate including slide plate slits 61, 62 and a slide plate protruding portion 63. The slide plate 6 is fitted in the slide plate fitting slot 71 of the base 7 so as to slide in the first to the fourth directions.

The slide plate slits 61, 62 are formed from the edge of the slide plate 6 facing the inside of the fan unit 1 toward an inner portion of the slide plate 6. The slide plate slits 61, 62 are wider than the diameter of the plate shaft 41 and the plate shaft 43, and hence the plate shaft 41 and the plate shaft 43 can pass through the slide plate slits 61, 62.

Figure 7A:
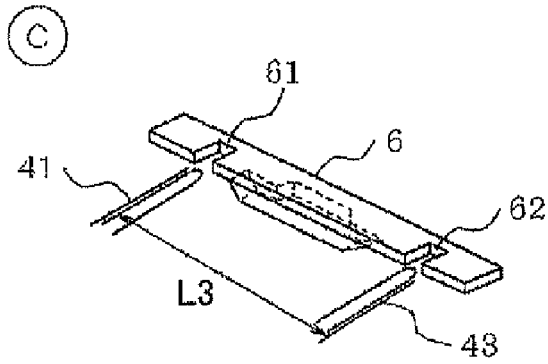
FIG. 7A is a perspective view and FIG. 7B is a cross-sectional view, enlarged from a portion designated by (C) in FIG. 4.
Figure 7B:
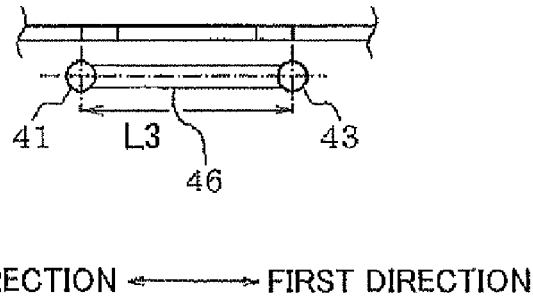

FIGS. 7A and 7B are enlarged drawings of a portion designated by (C) in FIG. 4. FIG. 7A is a perspective view of the slide plate 6, the plate shaft 41, and the plate shaft 43 of FIG. 4 in an enlarged scale. FIG. 7B is a cross-sectional view of the slide plate 6, the plate shaft 41 and the plate shaft 43 viewed from a lower left portion of FIG. 7A (from the inside of the fan unit 1 in FIG. 4). The distance between the sidewall of the slide plate slit 61 farther from the slide plate slit 62 and the sidewall of the slide plate slit 62 farther from the slide plate slit 61 is equal to the distance (L3) between the axial centers of the plate shaft 41 and the plate shaft 43.

Accordingly, in the case where the axial center of the plate shaft 41 falls on the center of the slide plate slit 61, the plate shaft 43 is deviated from the center of the slide plate slit 62, and covered with the slide plate 6. On the contrary, when the axial center of the plate shaft 43 is aligned with the center of the slide plate slit 62, the plate shaft 41 is deviated from the center of the slide plate slit 61, and covered with the slide plate 6. Therefore, there is no chance that the plate shaft 41 and the plate shaft 43 are both deviated from the slide plate slit 61 and the slide plate slit 62 at the same time.

Now referring to FIGS. 4 and 8A to 8D, the structure of the base 7 and the slide plate 6 will be described.

As already stated, the base 7 includes the slide plate fitting slot 71 and the base recessed portion 74 on the side of the air outlet of the fan unit 1, as shown in FIG. 4.

The base recessed portion 74 is the lowermost recess of the slide plate fitting slot 71, and located between the groove 72 and the groove 73. The base recessed portion 74 is a recessed portion having a trapezoidal cross-section when viewed from the inside of the fan unit 1, and includes a bottom slope 741, a bottom slope 742, and a bottom flat surface 743. The bottom slope 741 and the bottom slope 742 are inclined with respect to a line connecting the groove 72 and the groove 73.

The slide plate 6 includes the slide plate protruding portion 63, in addition to the foregoing slide plate slits 61 and 62.

The slide plate protruding portion 63 is a portion of the slide plate 6 opposing the base 7, provided between the slide plate slits 61, 62. The slide plate protruding portion 63 is a projection having a trapezoidal cross-section when viewed from the inside of the fan unit 1, and includes a slide plate inclined surface 631, a slide plate inclined surface 632, and a protruding flat portion 633.

The slide plate protruding portion 63 is fitted in the base recessed portion 74. In other words, the slide plate inclined surface 631 opposes the bottom slope 741; the slide plate inclined surface 632 opposes the bottom slope 742; and the protruding flat portion 633 opposes the bottom flat surface 743. Such configuration offers the advantage that the positioning between the slide plate 6 and the base 7 can be easily achieved when inserting the slide plate 6 into the base 7. After fitting the slide plate protruding portion 63 with the base recessed portion 74, a wedge 8 is attached so as to pass through the slide plate fitting slot 71. In this embodiment, the wedge 8 serves as a latch that prevents the slide plate 6 from coming off from the base 7. However, an allowance is secured between the slide plate 6 and the wedge 8. Accordingly, the slide plate 6 can still slide with respect to the base 7 after being fitted therein, as will be described later.

The base recessed portion 74 includes a base positioning guide 744 formed from the bottom flat surface 743 toward an outer side of the base 7. Likewise, the protruding flat portion 633 of the slide plate protruding portion 63 includes a slide plate positioning guide 634, projecting outwardly of the slide plate 6 upon fitting the slide plate 6 in the base 7.

The base positioning guide 744 is a semi-spherical concave portion, in which the slide plate positioning guide 634 is loosely fitted. Accordingly, upon fitting the slide plate positioning guide 634 in the base positioning guide 744, the centers of the slide plate 6 and the base 7 are mutually positioned, when the fan unit 1 is set in the second direction or the fourth direction.

FIGS. 8A to 8D are enlarged drawings of a portion designated by (D) in FIG. 4, showing sliding motions of the slide plate 6 after fitting the slide plate protruding portion 63 in the base recessed portion 74.

Figure 8A:
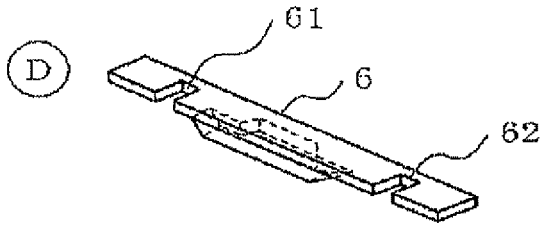
FIG. 8A is a perspective view and FIGS. 8B to 8D are cross-sectional views enlarged from a portion designated by (D) in FIG. 4, showing a sliding action of a slide plate 6 after fitting a slide plate protruding portion 63 into a base recessed portion 74.
Figure 8B:
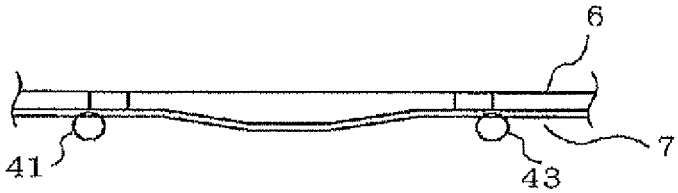
Figure 8C:
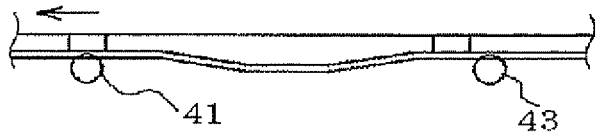
Figure 8D:
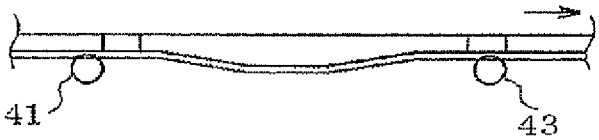

FIGS. 8B to 8D are cross-sectional views of the slide plate 6, the base 7, and the plate shafts 41, 43 viewed from a lower left portion of the sheet (from the inside of the fan unit 1 in FIG. 4). In these cross-sectional views, the slide plate slit 61, 62 formed in the slide plate 6 are at symmetrical positions with respect to a vertical reference line. Also, the grooves 72, 73 formed in the base 7 are vertically symmetrical. Furthermore, the plate shafts 41, 43 are vertically symmetrical. Here, regarding the base 7, FIGS. 8B to 8D only depict the upper surface opposing the slide plate 6.

FIG. 8B depicts a positional relationship among the plate shafts 41, 43, the slide plate 6, and the base 7, under a state that the slide plate protruding portion 63 is located at the center of the base recessed portion 74. In the case where the fan unit 1 is installed in the second direction or the fourth direction, fitting the protruding flat portion 633 in the base positioning guide 744 as above achieves the positioning between the slide plate 6 and the base 7, thereby presenting the state shown in FIG. 8B.

In this case, the reference lines of the symmetry of the slide plate 6, the base 7, and the plate shafts 41, 43 coincide with one another. As stated referring to FIG. 7B, the distance between the sidewall of the slide plate slit 61 farther from the slide plate slit 62 and the sidewall of the slide plate slit 62 farther from the slide plate slit 61 is equal to the distance between the axial centers of the plate shaft 41 and the plate shaft 43. Accordingly, the respective axial centers of the plate shafts 41, 43 are aligned with the sidewall of the slide plate slit 61 farther from the slide plate slit 62 and the sidewall of the slide plate slit 62 farther from the slide plate slit 61. The slide plate 6 holds the plate shafts 41, 43 in the grooves 72, 73, inhibiting the plate shafts from being deviated from the grooves. Consequently, in the case where the fan unit 1 is installed in the second direction or the fourth direction, there is no chance that the shutter 2 is entirely opened by the wind pressure of the fan.

FIG. 8C depicts a positional relationship among the plate shafts 41, 43, the slide plate 6, and the base 7, under a state that the fan unit 1 is set in the third installation direction, such that the gravity acts in the direction indicated by the arrow. In other words, FIG. 8C represents the case where the fan unit 1 is set such that the plate shaft 43 is located above the plate shaft 41. In this case, the slide plate 6 slides in the third direction (to the left on the sheet) owing to its self weight. Then the slide plate slit 61 comes in front of the plate shaft 41, so as to permit the plate shaft 41 to pass through the slide plate slit 61. Also, while sliding in the third direction, the slide plate 6 also slides such that the slide plate inclined surface 631 moves along the bottom slope 741. The slide plate 6 slides not only in the third direction, but also in the direction of the air blow of the fan unit 1 (upward on the sheet) with respect to the base 7 and the plate shaft 41. The clearance thus created between the plate shaft 43 and the slide plate 6 facilitates the plate shaft 43 to rotate. When the wind pressure is applied to the shutter plate 3 under such state, the shutter plate 3 rotates about the plate shaft 43. The plate shaft 41 passes through the slide plate slit 61 and is separated from the groove 72 and the slide plate 6.

FIG. 8D depicts a positional relationship among the plate shafts 41, 43, the slide plate 6, and the base 7, under a state that the fan unit 1 is set in the first installation direction, such that the gravity acts in the direction indicated by the arrow. In other words, FIG. 8D represents the case where the fan unit 1 is set such that the plate shaft 41 is located above the plate shaft 43. In this case, the slide plate 6 slides in the first direction (to the right on the sheet) owing to its self weight. Then the slide plate slit 62 comes in front of the plate shaft 43, so as to permit the plate shaft 43 to pass through the slide plate slit 62. Also, while sliding in the first direction, the slide plate 6 also slides such that the slide plate inclined surface 632 moves along the bottom slope 742. The slide plate 6 slides not only in the first direction, but also in the direction of the air blow of the fan unit 1 (upward on the sheet) with respect to the base 7 and the plate shaft 43. The clearance thus created between the plate shaft 41 and the slide plate 6 facilitates the plate shaft 41 to rotate. When the wind pressure is applied to the shutter plate 3 under such state, the shutter plate 3 rotates about the plate shaft 41. The plate shaft 43 passes through the slide plate slit 62 and is separated from the groove 73 and the slide plate 6.

The present invention is not limited to the foregoing embodiment, and various modifications may be made without departing from the scope of the present invention.

To cite a few examples, in the foregoing embodiment, the pivot shaft of the shutter 2 and that of the shutter plate 3 constituting the shutter 2 are orthogonal to each other, so that either of the pivot shafts is horizontally set at an upper portion of the rotating member (shutter 2 or shutter plate 3), regardless of whether the fan unit 1 is vertically or horizontally installed.

Instead, for example the pivot shaft for the plate-shaped shutter 2 may be diagonally set with respect to the fan unit 1. Such structure allows the pivot shaft to be located at a diagonally upper portion of the shutter 2, regardless of whether the fan unit 1 is vertically or horizontally installed. In this case, since the shutter 2 is opened and closed diagonally with respect to the direction of the gravity, the shutter 2 is, upon being rotated to open, subjected to a closing force about the diagonal pivot shaft by the self weight. Thus, one of the objects of the present invention, of allowing the shutter 2 to close despite changing the installation direction of the fan unit 1 in a plurality of directions, can be achieved.

An electronic apparatus that includes the fan unit 1 according to the foregoing embodiment, is capable of preventing a reverse flow of air with the shutter 2 despite a malfunction that causes the fan unit 1 to stop, even though the installation direction of the electronic apparatus (disk array unit 10 in the embodiment) is changed between vertical and horizontal. This is because the fan unit 1 includes the shutter 2 that opens and closes in different directions with respect to the fan unit 1, according to the installation direction of the fan unit 1. Accordingly, the electronic apparatus is exempted from degradation in cooling efficiency, and can extend the operation time.

The foregoing advantage leads to the following benefits, in the case of the disk array unit 10. In the rapidly spreading internet field, such business is growing that induces a user to make access to suppliers through the communication network, to thereby acquire market information, guide information, and digital data such as audial and visual information. A result is the highly increased utilization of servers and storage devices.

The servers and storage devices that accept the audial and visual information carry an enormous amount of information, and the disk array unit 10 having a large storage capacity which allows rapid retrieval and random access at a time is often employed, so as to quickly respond to the access from a multitude of users. Besides, the disk array unit 10 is continuously operated through days and nights. Stopping the operation of the disk array unit 10 immediately leads to suspension of the business.

It is assumed, for example, that a plurality of fan units 1 according to the foregoing embodiment is provided in the disk array unit 10. In the disk array unit 10 including the fan units according to the embodiment, a reverse flow of air can be prevented with the shutter 2 in case any given fan unit 1 fails, irrespective of the installation direction of the disk array unit 10. Accordingly, the disk array unit 10 can be exempted from the decrease in amount of air introduced into the disk array unit 10 from the front side, and can thereby maintain the cooling efficiency so as to continue the operation.

Also, depending on the condition of the installation site of the disk array unit 10, there are cases that the disk array unit 10 should be vertically installed and horizontally installed. With the disk array unit 10 including the fan unit 1 according to the embodiment, the party who installs the disk array unit 10 may decide or change the installation direction of the disk array unit 10, without taking the opening/closing direction of the shutter 2 of the fan unit 1 into consideration.

It is apparent that the present invention is not limited to the above embodiment, and may be modified and changed without departing from the scope and spirit of the invention.

What is claimed is:

1. A fan unit, comprising:

a shutter that closes in different directions with respect to said fan unit, according to an installation direction of said fan unit, wherein said shutter includes a shutter plate, and a plurality of shafts that serves as a pivot shaft for said shutter plate, and wherein said plurality of shafts includes a first shaft and a second shaft, and said first shaft and said second shaft are orthogonal to each other.

2. The fan unit according to claim 1, said fan unit including a fan, wherein said shutter blocks an air outlet of said fan when said fan is stopped, and is rotated by a wind pressure of said fan about a pivot shaft thus to be opened when said fan is working; and said shutter rotated and opened is subjected to a closing force by a self weight thereof about said pivot shaft, in each of cases where said fan unit is installed in a plurality of directions.

3. The fan unit according to claim 1, wherein said shutter includes:

a third shaft that serves as a pivot shaft for said shutter plate; and said first shaft and said third shaft are parallel to each other.

4. The fan unit according to claim 3, wherein said shutter includes:

a fourth shaft that serves as a pivot shaft for said shutter plate; and said second shaft and said fourth shaft are parallel to each other.

5. The fan unit according to claim 4, wherein said second shaft and said fourth shaft are connected to said first shaft and said third shaft respectively; and said first, said second, said third, and said fourth shaft are respectively attached to an end portion of said shutter plate.

6. The fan unit according to claim 5, wherein said shutter plate includes:

a second bearing on an end portion thereof so as to support said second shaft, and a fourth bearing at said other end portion so as to support said fourth shaft;

in the case where a wind pressure is applied to said shutter plate with said fan unit being installed such that said second shaft is located above said fourth shaft, said fourth bearing is disengaged from said fourth shaft and said shutter plate rotates about said second shaft; and in the case where a wind pressure is applied to said shutter plate with said fan unit being installed such that said fourth shaft is located above said second shaft, said second bearing is disengaged from said second shaft and said shutter plate rotates about said fourth shaft.

7. The fan unit according to claim 6, wherein said second bearing includes a first engaging portion having a J-shaped cross-section so as to be engaged with said second shaft, said fourth bearing includes a second engaging portion having a J-shaped cross-section so as to be engaged with said fourth shaft; and an inner surface of said J-shaped curved portion of said first engaging portion and an inner surface of said J-shaped curved portion of said second engaging portion are opposing each other.

8. The fan unit according to claim 7, wherein said shutter plate moves away from said second shaft toward said fourth shaft and said second engaging portion is disengaged from said fourth shaft, when said fan unit is installed such that said second shaft is located above said fourth shaft; and said shutter plate moves away from said fourth shaft toward said second shaft and said first engaging portion is disengaged from said second shaft, when said fan unit is installed such that said fourth shaft is located above said second shaft.

9. The fan unit according to claim 8, wherein said shutter plate is a first shutter plate;

said shutter includes:

a second shutter plate adjacent to said first shutter plate, a fifth shaft, and a sixth shaft;

said fifth shaft and said sixth shaft are connected to said first shaft and said third shaft respectively, and said second shaft, said fourth shaft, said fifth shaft and said sixth shaft are aligned in the order of said numerals;

said second shutter plate includes:

a fifth bearing on an end portion thereof so as to support said fifth shaft, and a sixth bearing at the other end portion so as to support said sixth shaft;

said fifth bearing includes a third engaging portion having a J-shaped cross-section so as to be engaged with said fifth shaft, said sixth bearing includes a fourth engaging portion having a J-shaped cross-section so as to be engaged with said sixth shaft;

an inner surface of said J-shaped curved portion of said third engaging portion and an inner surface of said J-shaped curved portion of said fourth engaging portion are opposing each other;

said second engaging portion is adjacent to said third engaging portion; and a distance between a tip portion of said second engaging portion and a tip portion of said third engaging portion is longer than an interval between said fourth shaft and said fifth shaft.

10. The fan unit according to claim 5, wherein said shutter includes:

a first bearing that supports said first shaft, and a third bearing that supports said third shaft;

in the case where a wind pressure is applied to said shutter plate with said fan unit being installed such that said first shaft is located above said third shaft, said third shaft is disengaged from said third bearing and said shutter plate is rotated about said first shaft; and in the case where a wind pressure is applied to said shutter plate with said fan unit being installed such that said third shaft is located above said first shaft, said first shaft is disengaged from said first bearing and said shutter plate is rotated about said third shaft.

11. The fan unit according to claim 10, wherein said shutter includes:

a base including said first bearing and said third bearing, a slide plate that covers said first bearing and said third bearing, and slides over said base;

said first bearing includes a first groove that pivotally supports said first shaft;

said third bearing includes a second groove that pivotally supports said third shaft;

said slide plate includes:

a first recessed portion and a second recessed portion;

said slide plate slides away from said first shaft toward said third shaft, and said second recessed portion is located in front of said second groove, when said fan unit is installed such that said first shaft is located above said third shaft; and said slide plate slides away from said third shaft toward said first shaft, and said first recessed portion is located in front of said first groove, when said fan unit is installed such that said third shaft is located above said first shaft.

12. The fan unit according to claim 11, wherein a distance between said first recessed portion and said second recessed portion is shorter than a distance between said first shaft and said third shaft.

13. The fan unit according to claim 12, wherein said base includes:

a base recessed portion including a first bottom slope and a second bottom slope, inclined with respect to a line connecting said first groove and said second groove and located on a surface of said base opposing said slide plate and between said first groove and said second groove; and said slide plate includes:

a slide plate protruding portion including a first slide plate inclined surface opposing said first bottom slope, and a second slide plate inclined surface opposing said second bottom slope, on a surface opposing said base and between said first recessed portion and said second recessed portion.

14. An electronic apparatus, comprising a fan unit including a shutter that closes in different directions with respect to said fan unit, according to an installation direction of said fan unit, wherein said shutter includes a shutter plate, and a plurality of shafts that serves as a pivot shaft for said shutter plate, and wherein said plurality of shafts includes a first shaft and a second shaft, and said first shaft and said second shaft are orthogonal to each other.

* * * * *